US010111531B2

(12) United States Patent
Sánchez Zarza

(10) Patent No.: US 10,111,531 B2
(45) Date of Patent: Oct. 30, 2018

(54) MATTRESS ASSEMBLY

(71) Applicant: LANGEL SYSTEM INTERNATIONAL, S.L., Saragossa (ES)

(72) Inventor: Alberto Sánchez Zarza, Saragossa (ES)

(73) Assignee: LANGEL SYSTEM INTERNATIONAL, S.L., Saragossa (ES)

( * ) Notice: Subject to any disclaimer, the term of this patent is extended or adjusted under 35 U.S.C. 154(b) by 426 days.

(21) Appl. No.: 14/435,129

(22) PCT Filed: Oct. 31, 2013

(86) PCT No.: PCT/EP2013/072759
§ 371 (c)(1),
(2) Date: Apr. 10, 2015

(87) PCT Pub. No.: WO2014/075928
PCT Pub. Date: May 22, 2014

(65) Prior Publication Data

US 2015/0272339 A1 Oct. 1, 2015

(30) Foreign Application Priority Data

Nov. 13, 2012 (ES) ..... 201231201 U
Nov. 13, 2012 (ES) ..... 201231203 U
(Continued)

(51) Int. Cl.
*A47C 27/00* (2006.01)
*A47C 21/08* (2006.01)
(Continued)

(52) U.S. Cl.
CPC ..... *A47C 27/001* (2013.01); *A47C 17/32* (2013.01); *A47C 19/04* (2013.01); *A47C 21/08* (2013.01);
(Continued)

(58) Field of Classification Search
CPC . A47C 17/165; A47C 17/1655; A47C 17/207; A47C 17/2076; A47C 17/32;
(Continued)

(56) References Cited

U.S. PATENT DOCUMENTS 3,327,328 A * 6/1967 Slivoski ..... A47C 19/04 5/181
5,502,853 A * 4/1996 Singleton ..... A47C 21/006 5/185
(Continued)

FOREIGN PATENT DOCUMENTS

EP 0943269 A2 9/1999

OTHER PUBLICATIONS

International Search Report (ISR) and Written Opinion, International Application No. PCT/EP2013/072759, International Filing Date Oct. 31, 2013, dated Jan. 21, 2014, 8 pages, European Patent Office, Rijswijk Netherlands.

*Primary Examiner* — Nicholas F Polito
(74) *Attorney, Agent, or Firm* — Peter B. Scull; Hamilton, DeSanctis & Cha LLP

(57) ABSTRACT

A main mattress and a supplement mattress attached thereto. The supplement mattress may have a main body having two lateral extensions, a footboard extension, a headboard extension, and a tubular structure. Extensions can be rotated 90° or 180° together with the tubular structure. A fitted sheet may also be provided. The surface of the mattress assembly can be expanded and it may provide a safety barrier for preventing the user from falling to the ground.

14 Claims, 18 Drawing Sheets

(30) Foreign Application Priority Data

| | | |
|---|---|---|
| Apr. 19, 2013 | (ES) | 201330472 U |
| Apr. 25, 2013 | (ES) | 201330502 U |
| Jul. 22, 2013 | (ES) | 201330905 U |

(51) Int. Cl.

| | |
|---|---|
| ***A47C 17/32*** | (2006.01) |
| ***A47C 19/04*** | (2006.01) |
| ***A47G 9/02*** | (2006.01) |
| *A61G 7/05* | (2006.01) |

(52) U.S. Cl.
CPC ..... *A47G 9/0246* (2013.01); *A61G 7/0509* (2016.11)

(58) Field of Classification Search
CPC ..... A47C 19/022; A47C 19/04; A47C 21/08; A47C 27/001; A47G 9/0246; A61G 7/0507; A61G 7/0509; A61G 7/0522
USPC ..... 5/941, 946
See application file for complete search history.

(56) References Cited

U.S. PATENT DOCUMENTS

| | | | | |
|---|---|---|---|---|
| 5,644,804 | A * | 7/1997 | Wang | A47C 17/165 5/12.1 |
| 5,745,936 | A * | 5/1998 | Van McCutchen | A61G 7/0507 5/425 |
| D467,117 | S | 12/2002 | Bruce | |
| 6,684,419 | B1 * | 2/2004 | Perla | A61G 7/053 5/624 |
| 8,001,638 | B1 | 8/2011 | Quinter et al. | |
| 8,161,584 | B1 * | 4/2012 | Del Rio | A47D 15/008 5/424 |
| 2005/0257319 | A1 | 11/2005 | Ikeda et al. | |
| 2013/0086746 | A1 * | 4/2013 | Vanderpohl | A61G 7/0507 5/428 |

* cited by examiner

MATTRESS ASSEMBLY

TECHNICAL FIELD

The present disclosure relates to a mattress assembly which allows the surface of a mattress to be expanded.

BACKGROUND

Mattress assemblies are known having a supplement mattress attached to a main mattress. The supplement mattress is provided on the main mattress by sewing, either at the factory or by any other known industrial process. This has the disadvantage that this type of mattresses only provides a double bed.

In addition, known mattresses are currently made from standard patterns as regards to size, with bed frames, canapés, or upholstered bed bases being manufactured in the same way in coincidence with the standard size of the mattress. This has the disadvantage that when a larger mattress surface is needed it is necessary to replace it and, in addition, to replace the corresponding bed frame, canapé or upholstered bed base. Such replacement may not be possible in many cases since the lack of space may prevent a mattress from being replaced with a larger one.

A further disadvantage is that the mattresses do not have standard safety barriers for preventing the user from falling to the ground, especially when it comes to young children, elderly, disabled and dependent persons.

Sheets are also known having adjustment mechanisms for adjusting them on a conventional mattress. Known sheets have the disadvantage that when the size or particularities of the mattress are not conventional as stated above, known sheets could not be adapted to some mattress configurations.

Therefore there is a need to provide a mattress assembly which allows its surface to be expanded and, in addition, which is capable of providing the user with a safety barrier for preventing her/him from falling to the ground.

SUMMARY

A mattress assembly is disclosed herein which allows the surface of a mattress to be expanded and which is capable of providing the user with safety devices or barriers for preventing her/him from falling to the ground. The present mattress assembly further provides many advantages, as it will be clear in the following.

The present mattress assembly is provided with a supplement mattress including a main body which includes two lateral extensions and a footboard extension. In some examples, the supplement mattress further includes a headboard extension.

Said extensions can be rotated 90° or 180° so that they can form a surface extension in a completely horizontal plane to the main body or perpendicular thereto, respectively.

The present mattress assembly may further include a tubular structure provided in the perimeter of said extensions. The tubular structure may be fixed or assembled at the factory, or they may be assembled by the user by fast opening and closing devices. This tubular structure is configured such that assembly and disassembly operations are facilitated and it is advantageous in case of transportation, transfers, etc.

The above mentioned fast opening and closing devices may include a textile section. This textile section may be easily wound on a corresponding tube section of the tubular structure fixing its position and ensuring its assembly of the supplement mattress perimeter.

As stated above, the tubular structure of the supplement mattress may include a number of tube sections. Specifically, the tubular structure may include two long sections, for assembling of the lateral extensions; three middle sections, one for assembling a headboard extension and two intended for assembling a footboard extension and for connecting the footboard extension with the main body; and eight short sections intended for assembling angles formed by connection between the lateral and footboard extensions with the main body. All the sections are attached to each other by eight bends and four folding hinges positioned at connecting angles between main body and lateral and footboard extensions. Therefore, the hinges can be rotated 90° for oversizing the mattress so that the surface is totally flush with the main body, while they can be also rotated 180° to be perpendicular to the main body. In this case, a security barrier preventing children, disabled and dependent persons from falling to the ground is thus formed.

The tubular structure provides the present mattress assembly with a frame along the perimeter of the supplement mattress. The tubular structure may include tube sections which can be slidingly adjusted to conform to the size of the supplement mattress. This allows the lateral extension and the footboard extension to be adapted to the size of the supplement mattress.

The tubular structure may be also provided along its perimeter lined with fabric for attaching to the supplement mattress.

The main body of the supplement mattress is provided with clamps or girths for attaching to a main mattress. The clamps or girths are positioned at both sides of the back portion of the main body. However, the main body could be alternatively or additionally sewn to the main mattress, forming a single body.

In one example of the present mattress assembly, the lateral extensions may be divided into several separate areas. The separate areas may be adaptable to hinged bases movable through an elevation angle at different fixed positions up to a maximum of 90° to the supplement mattress. The separate areas of the lateral extensions are provided in connection with the tubular structure that is provided on the perimeter with flexible and/or adjustable sections, arranged in the footboard area, headboard area and lateral extensions. The headboard will be described further below.

The tube sections of the tubular structure in this example may include corresponding hinged areas, coincident with the separate areas of the supplement mattress. The separate areas may be arranged such that they are capable of overlapping each other as they are hinged.

According to a variant of the present mattress assembly and with the above mentioned purpose of expanding the surface of a mattress without having to replace it with a larger one and without having to replace the bed frame, or upholstered bed base, the lateral extension of the present mattress assembly may include two solid upholstered bed bases. The two solid upholstered bed bases, facing each other, keep a separation distance equivalent to the width dimensions of a mattress. This may be carried out by at least two structural tubes intended for coupling L-adjusting tubes, two being positioned on each side and in an opposite position, provided with a hinge at its free end positioned at the ends of the solid upholstered bed bases.

In this case, the footboard extension may include a solid, upholstered bed base shorter than the solid upholstered bed bases of the lateral extension. The bed base has at least two hinges on its inner surface, one arranged at each end, coupled to its corresponding L-adjusting tube. The hinges are provided at one free end thereof with a clamp for coupling with the structural tube of the lateral extension.

The solid upholstered bed bases of the lateral extension and the footboard extension may be provided on the top thereof with a reinforced padding along its entire length. This avoids discomfort to the user when sitting on the sides of the bed.

The solid upholstered bed bases of the lateral extension and the footboard extension may be adjustable in height through a threaded insert. This threaded insert connects the corresponding hinge with the adjusting tube, allowing them to be aligned with the mattress.

In one alternative example of the present mattress assembly, the lateral extension may include two solid upholstered bed bases provided with at least two hinges at the ends of its back, positioned one at each end, provided with a coupling hinge joint in its central portion.

In a further alternative example the footboard extension may include a solid upholstered bed base shorter than the solid upholstered bed bases of the lateral extension. Such upholstered bed base is provided with at least two hinges on its inner surface, positioned one at each end, and it may further include, in a central portion thereof, a coupling hinge joint.

The coupling hinge joint is intended for being attached vertically on another surface, such as a canapé, allowing raising and/or lowering of the solid upholstered bed bases from the corresponding assemblies. The coupling hinge joint may be actuated, for being raised or lowered, manually or by a remotely controlled electric motor.

The present mattress assembly may be further provided with a fitted sheet. This fitted sheet may include an elastic element along its entire perimeter. This facilitates the fitted sheet to be adapted to the mattress assembly. In this case, the fitted sheet has a main body that is provided with lateral extensions. The ends of the fitted sheet are configured by a cutout forming an angle of 90°. The fitted sheet has a number of textile sections in the connection between the main body with the lateral extensions. Such textile sections can be passed through slots formed in the supplement mattress, between the connection of the lateral and footboard extensions, such that the free end of the textile sections fit the respective ends of the fitted sheet, since it clamps on the sides of the supplement mattress through one or more fasteners.

The fitted sheet can be perfectly fitted on the mattress assembly even when the user extends the lateral extensions of the supplement mattress, preventing the fitted sheet from coming out of the lateral extensions.

As stated above, the present mattress assembly may be provided with a headboard extension. The headboard extension can be rotated together with the tubular structure through different positions, up to 90° to the supplement mattress. The headboard extension can be thus positioned at different angles giving the users more comfortable positions for relaxing or just for reading.

In some examples, the headboard extensions may include separate hinged areas movable through an elevation angle at different fixed positions. Therefore, different users on the present mattress assembly can lay their head at different angles.

The tubular structure of the supplement mattress may be provided with two hinges in the connecting angle between the headboard extension and the lateral extensions. Hinges allow an angle of rotation for raising the headboard at different fixed positions up to a maximum of 90° to the supplement mattress. A security barrier can be thus formed preventing children, disabled and dependent adults from falling to the ground.

The present mattress assembly may provide one or multiple advantages over the currently available mattresses.

One important advantage is that the surface of the mattress assembly can be extended efficiently by a tubular structure provided along its perimeter such that the surface of the mattress assembly is totally flush with the main body. This avoids the replacement of the mattress and its corresponding bed frame, canapé or upholstered bed base.

A further advantage is that, in addition, the surface of the mattress assembly can be extended efficiently perpendicular to the mattress assembly. This results in that a security barrier may effectively be formed preventing the user from falling to the ground. The provision of a hinged headboard in the supplement mattress results in an enhanced security barrier on its four sides, preventing the user from falling to the ground.

It is important to note that the supplement mattress can be attached to any type of mattress, by clamps or girths and with the help of textile pieces as stated above.

Additional objects, advantages and features of examples of the present mattress assembly will become apparent to those skilled in the art upon examination of the description, or may be learned by practice thereof.

BRIEF DESCRIPTION OF THE DRAWINGS

Particular examples of the present mattress assembly will be described in the following by way of non-limiting examples, with reference to the appended drawings, in which:

FIG. 9 which includes and is defined by sub-part

FIG. 21 which includes and is defined by sub-part

DETAILED DESCRIPTION OF EXAMPLES

Figure 1:
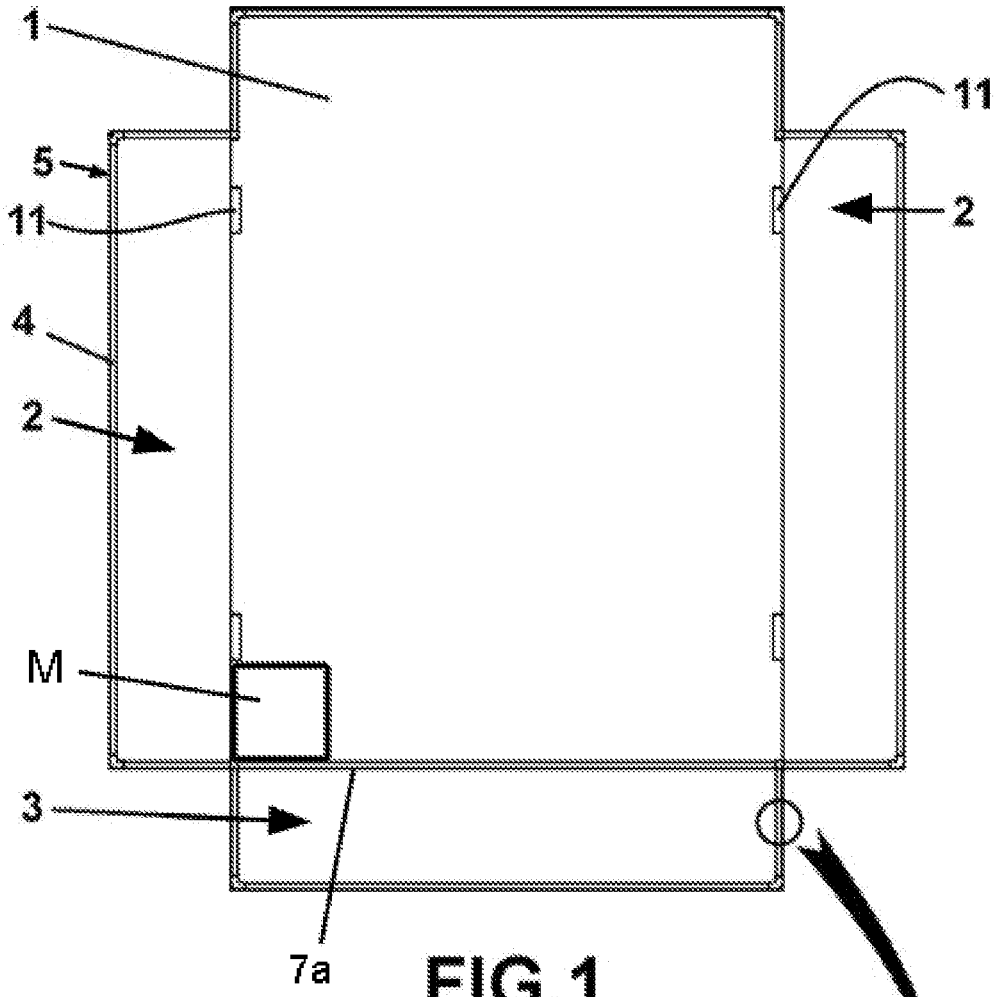
FIG. 1 is a plan view showing one example of a supplement mattress of the mattress assembly from its back.
Figure 2:
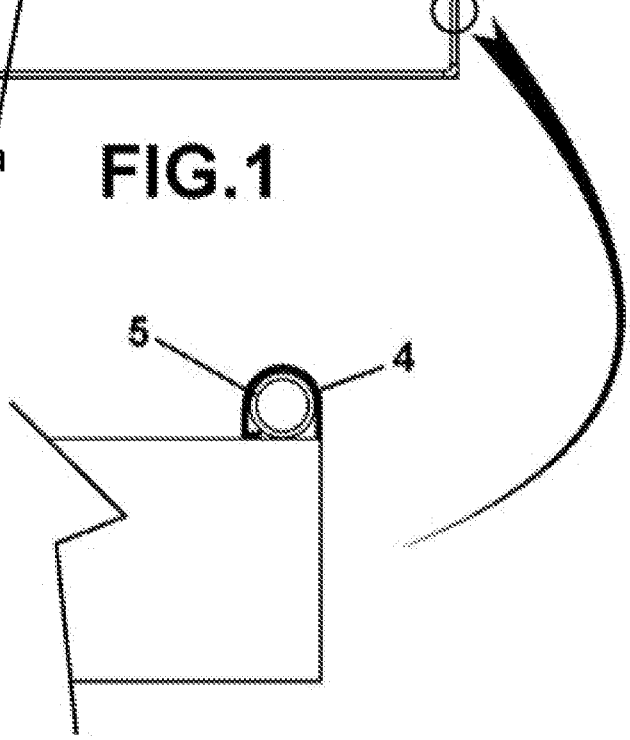
FIG. 2 shows a constructive detail of fast opening and closing devices for the tubular structure.

Reference is made to FIGS. 1-33 of the drawings where examples of the present mattress assembly are schematically shown.

The present mattress assembly includes a main mattress, a supplement mattress 1 and a tubular structure 5.

The supplement mattress 1 may include a main body having two lateral extensions 2 and a footboard extension 3. As it will described in connection with the examples of FIGS. 26-33, a headboard extension 17 may alternatively further be provided.

The main body of the supplement mattress 1 together with the extensions 2, 3 can form an extending surface in a plane completely horizontal. This is carried out by rotating said extensions 2, 3 90° from their vertical position. In addition, the extensions 2, 3 can be also rotated 180° as it will be explained below.

Figure 3:
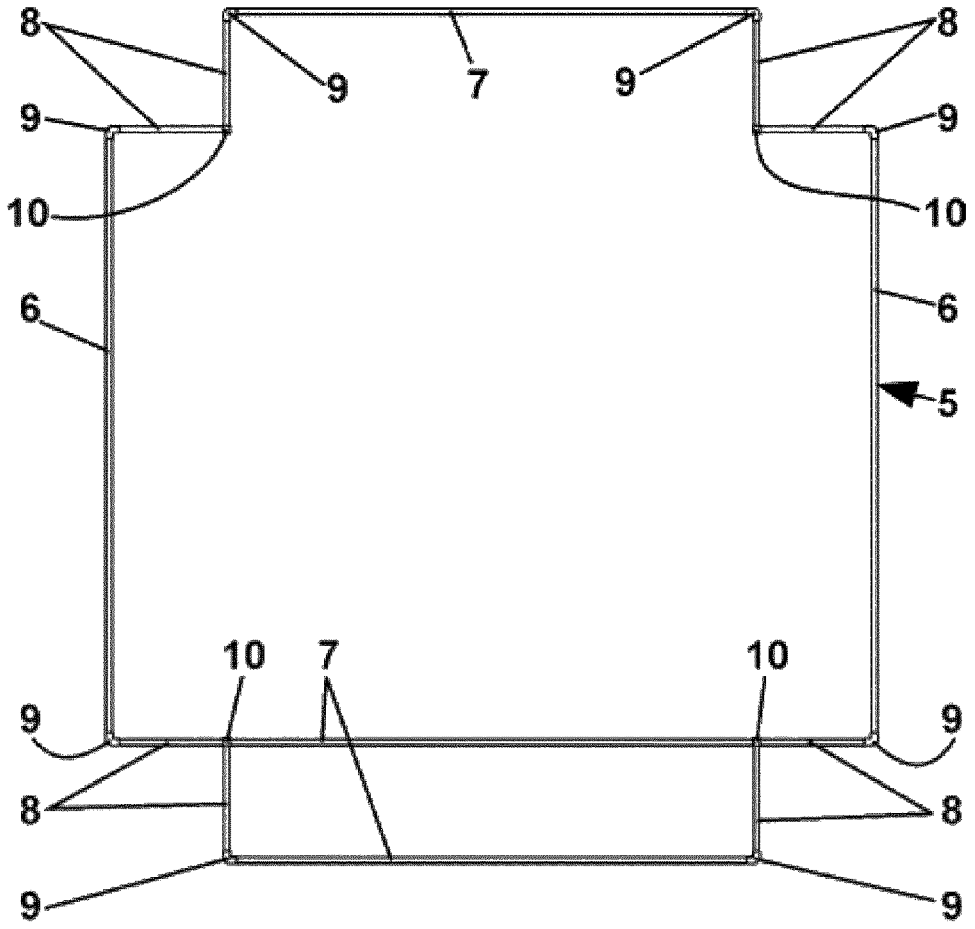
FIG. 3 is a plan view of the tubular structure.
Figure 4:
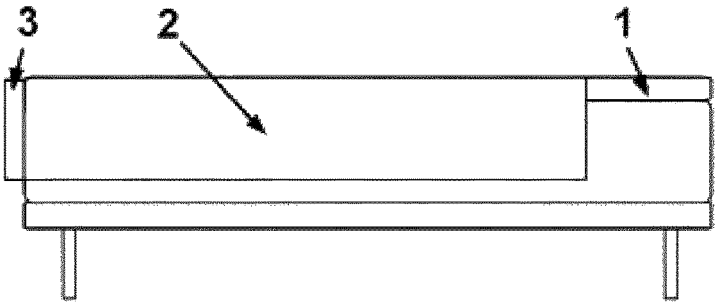
FIG. 4 is an elevational view of the supplement mattress fitted on the main mattress in a rest position.
Figure 5:
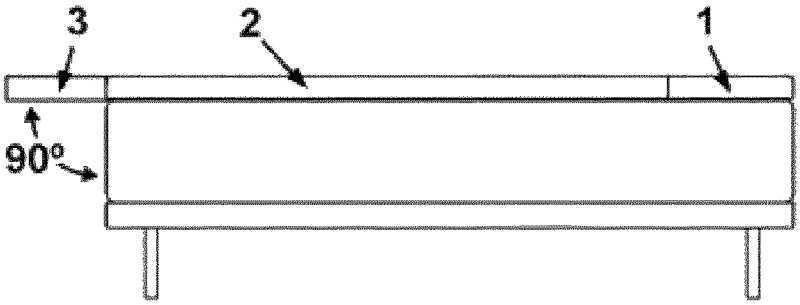
FIGS. 5 and 6 are elevational and plan views, respectively, of the supplement mattress fitted on the main mattress with the lateral and footboard extensions extending the supplement mattress surface in a completely horizontal plane to the main body through a 90° rotation.
Figure 6:
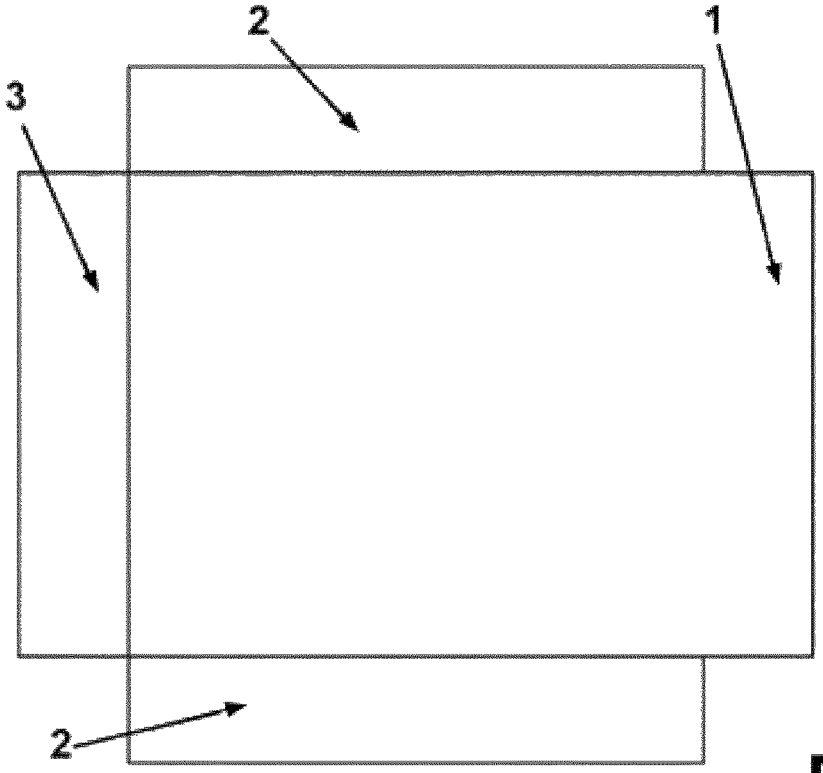
Figure 7:
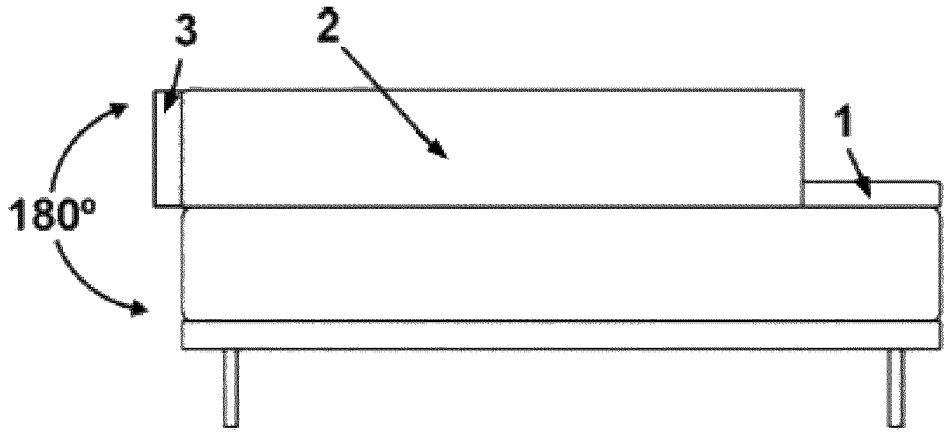
FIGS. 7 and 8 are elevational and plan views, respectively, of the supplement mattress fitted on the main mattress with lateral and footboard extensions extending the supplement mattress surface in a plane completely perpendicular to the main body through a 180° rotation, forming a safety barrier for preventing the user from falling.
Figure 8:
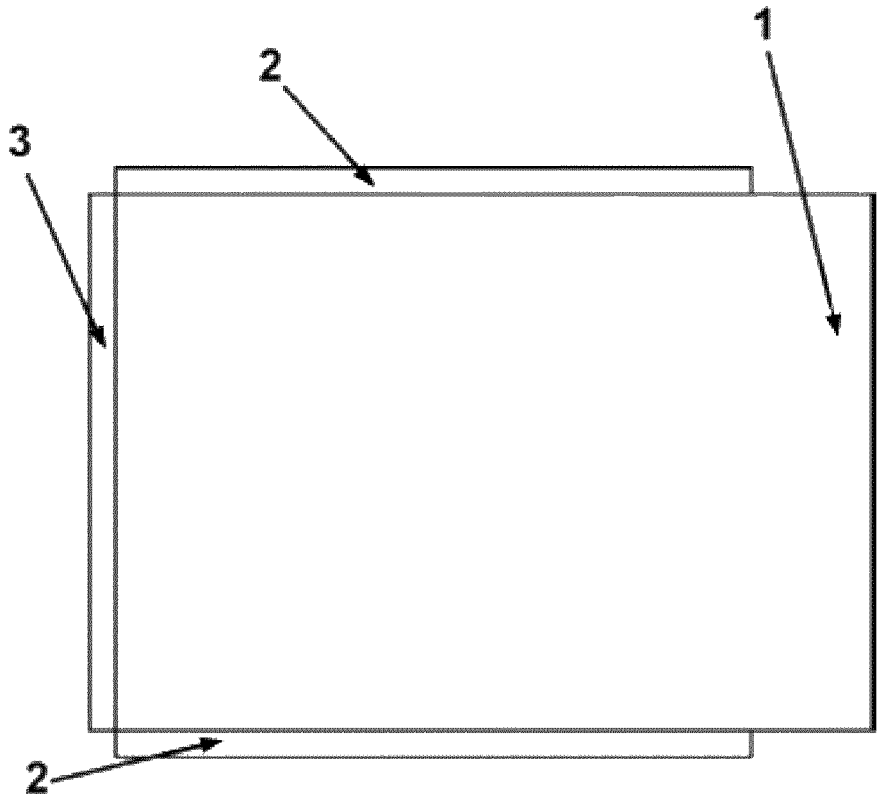

The tubular structure 5 is provided along the perimeter of the main body. Fast opening and closing mechanisms 4 are provided for assembling it. The tubular structure 5 may include a number of tube sections. Specifically it may include two long sections 6 for the assembly of the lateral extensions 2; three central sections 7, one for the assembly of the headboard and two intended for the assembly of the footboard extension 3 and for attaching the footboard extension 3 to the main body; eight short sections 8 for the assembly of angles forming the attachment between the lateral extensions 2 and the footboard extension 3, with the main body. All the tube sections are attached to each other by eight bends 9 and four hinges 10 rotatable through 90° and 180° as shown in FIG. 3. The hinges 10 are positioned in the connecting angles between the main body and the lateral extensions 2 and the footboard extension 3.

The main body of the supplement mattress 1 may include clamps or girths 11 positioned at both sides of its back. Said clamps or girths 11 are intended for coupling the supplement mattress 1 on the main mattress.

Figure 9A:
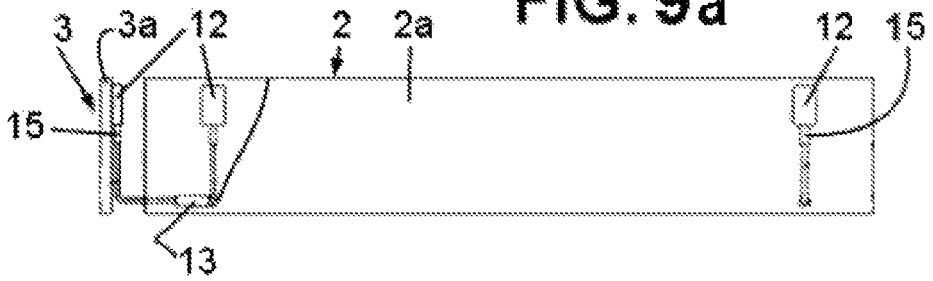
FIGS. 9*a* and 9*b*, shows an elevational and a plan view of one example of the mattress assembly.
Figure 9B:
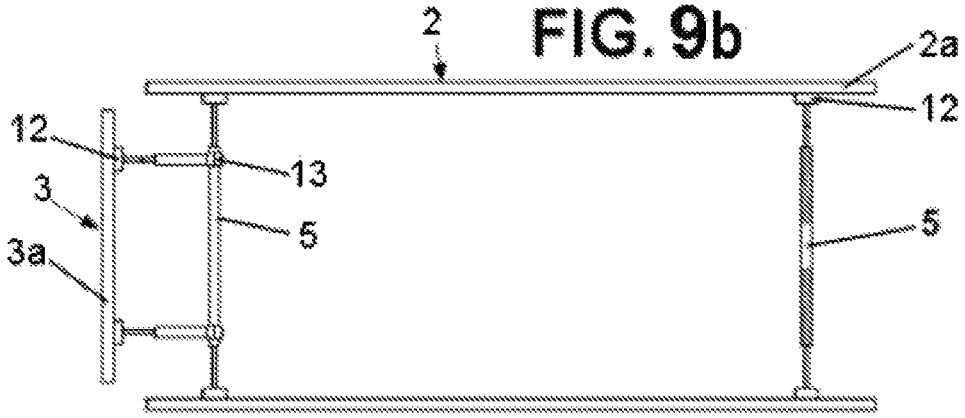
Figure 10:
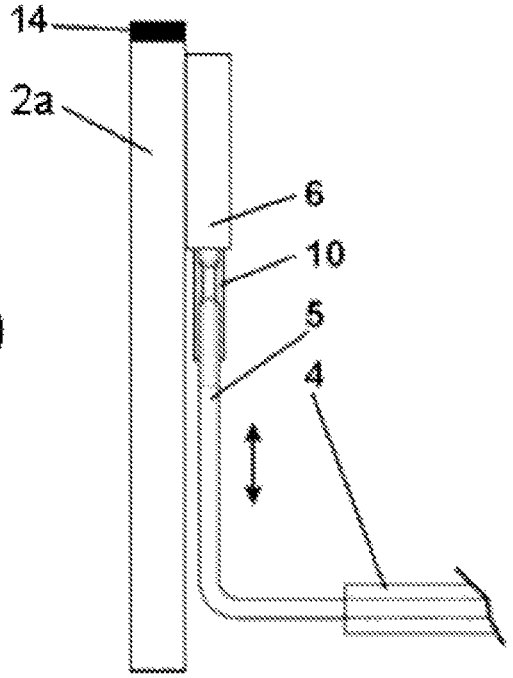
FIG. 10 shows a constructive detail of the mattress assembly shown in FIG. 9.
Figure 11:
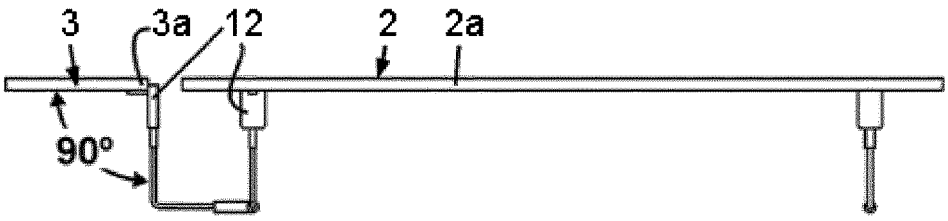
FIG. 11 is an elevational view of the mattress assembly shown in FIG. 9 with the solid upholstered bed base of the right lateral extension and the solid upholstered bed base of the footboard extension shown forming an extension surface in a completely horizontal plane to the mattress through a 90° rotation.
Figure 12:
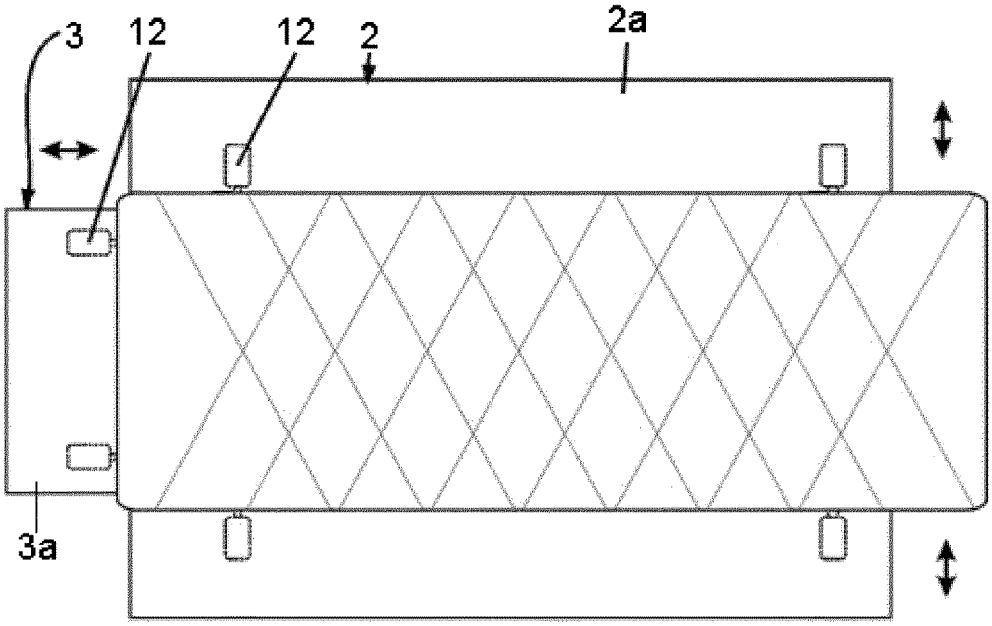
FIG. 12 shows a view of the mattress assembly illustrated in FIG. 9 with the extensions expanded extending its surface.
Figure 13:
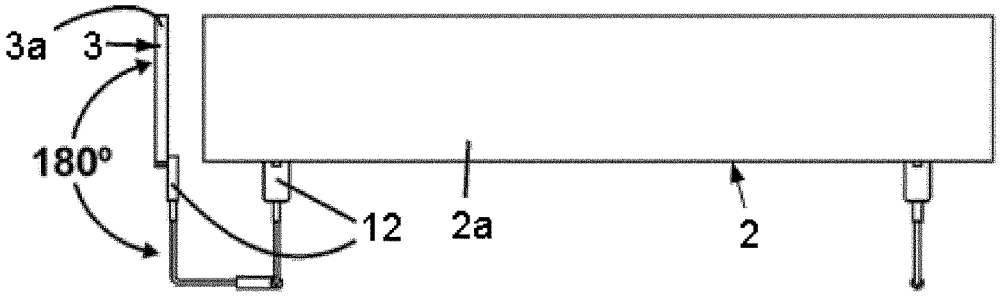
FIG. 13 is an elevational view of the mattress assembly in FIG. 9 showing the solid upholstered bed base of the right lateral extension and the solid upholstered bed base of the footboard extension forming a safety surface on a plane completely perpendicular to the mattress by rotating 180°, thus preventing the user from falling down.
Figure 14:
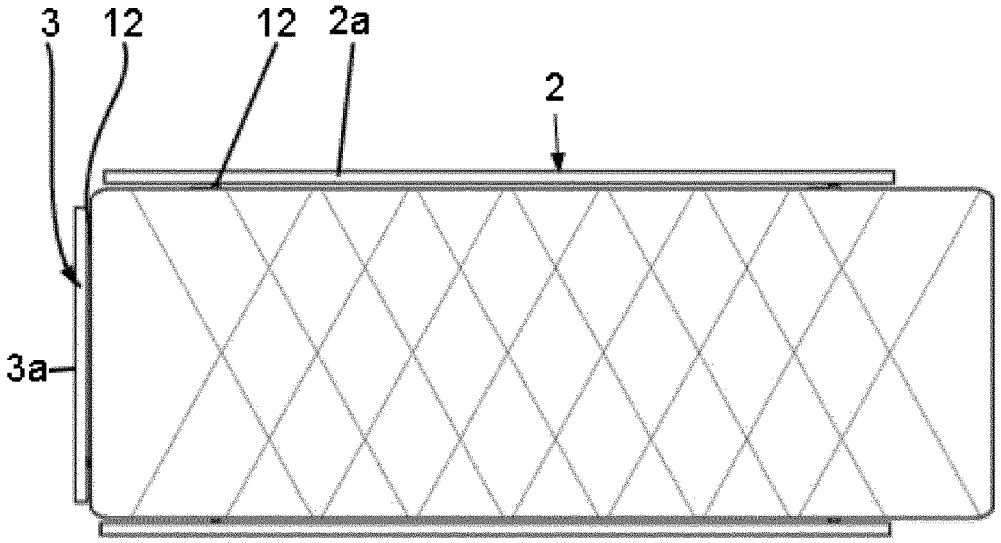
FIG. 14 shows a plan view of the mattress assembly shown in FIG. 9 with the extensions rotated 180° forming a safety barrier.
Figure 15:
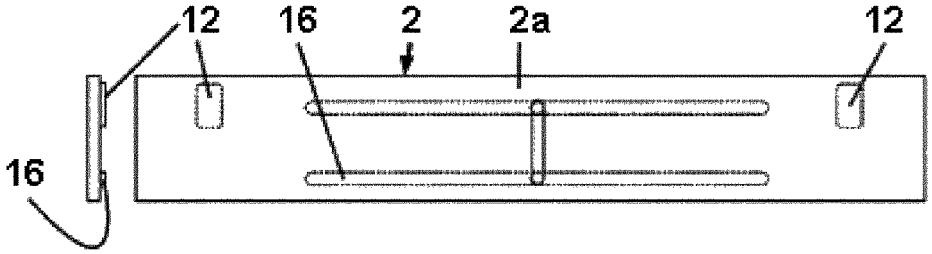
FIG. 15 shows side and elevational views showing a solid upholstered bed base of the lateral extension in one alternative example.
Figure 16:
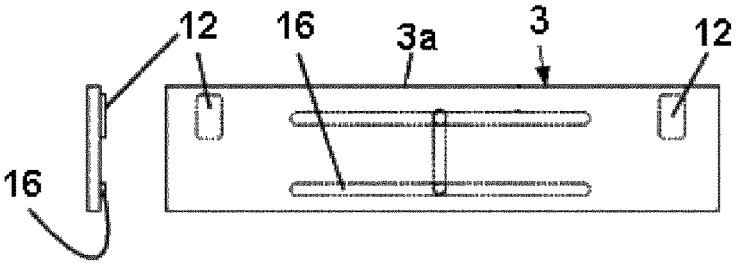
FIG. 16 shows side and elevational views showing the lateral extension and the footboard extension in one alternative example.
Figure 17:
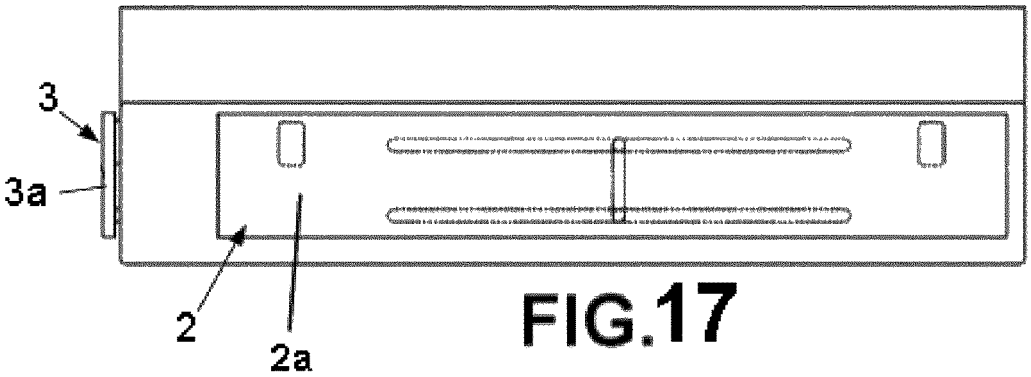
FIG. 17 shows the coupling of the lateral extension and the footboard extension on a canapé.
Figure 18:
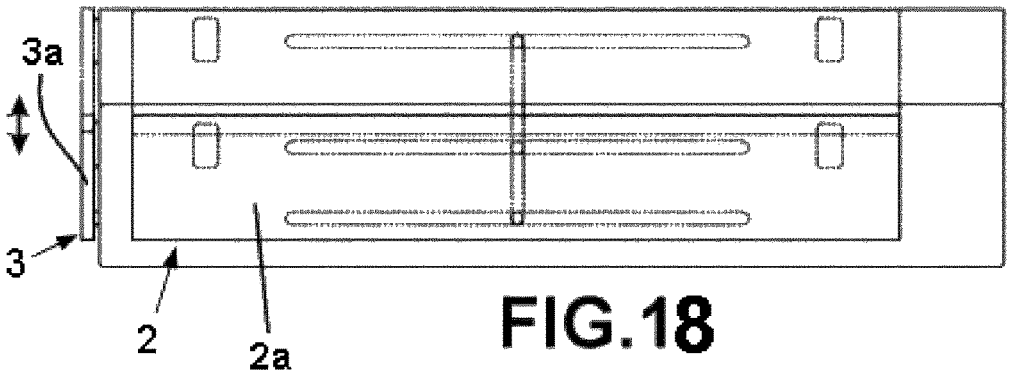
FIG. 18 shows the coupling of the lateral extension and the footboard extension on a canapé, the hinge acting when ascending, being flush with the mattress.
Figure 19:
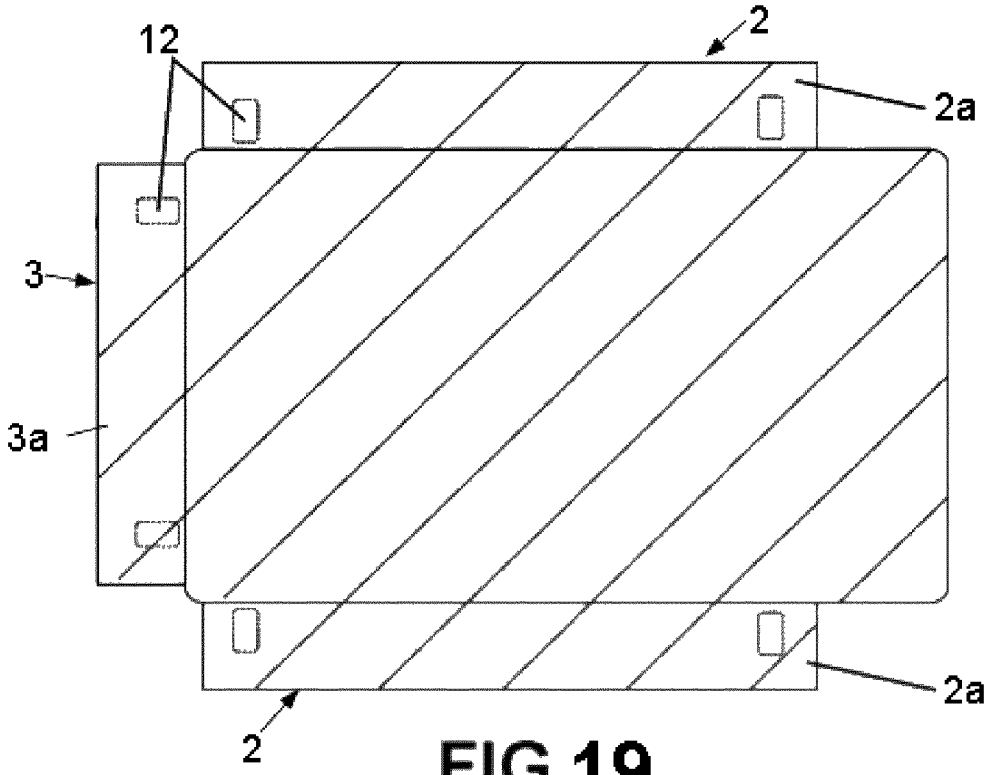
FIG. 19 is a plan view of a mattress on a canapé with the lateral extension and the footboard extension extended and positioned flush with the mattress by a 90° rotation.
Figure 20:
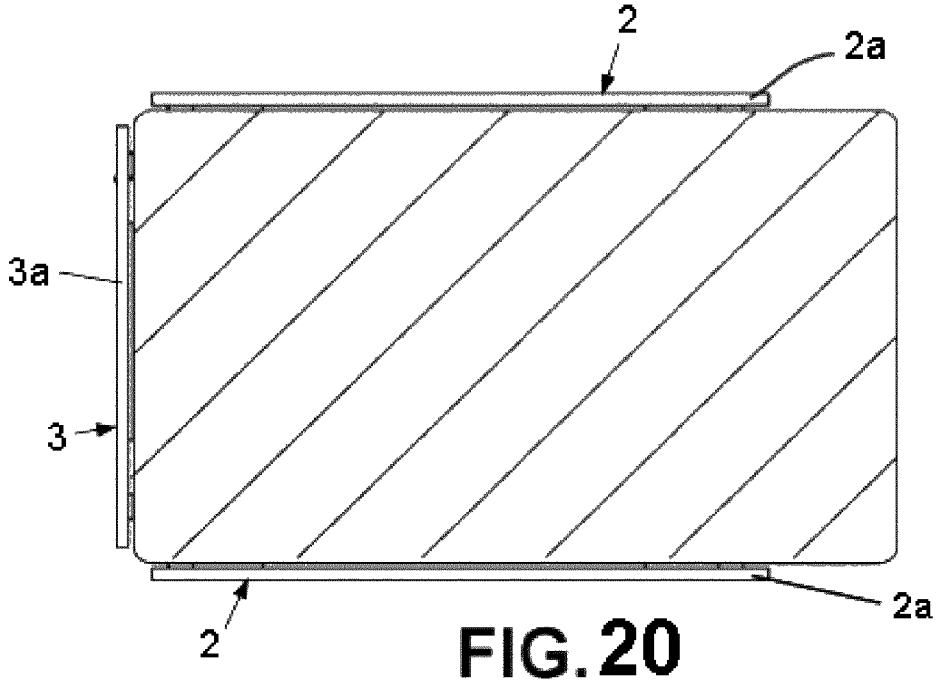
FIG. 20 is a plan view of a mattress on a canapé with the lateral extension and the footboard extension coupled thereto in a plane completely perpendicular to the mattress through a 180° rotation, preventing the user from falling down.

Referring now to the examples shown in FIG. 9 (not separately shown but includes and is defined by sub-part FIGS. 9*a* and 9*b*), and 10-20 of the drawings, the lateral extensions 2 of the supplement mattress 1 may include solid upholstered bed bases 2*a*. Said solid upholstered bed bases 2*a* face each other and keep a separation distance equivalent to the width dimensions of the main mattress. This is carried out by a tubular structure 5. In said examples, the tubular structure 5 may include tube sections lined with fabric intended for coupling L-adjusting tubes, two being positioned on each side and in a opposite position, provided with a hinge 10 at its free end positioned at the ends of solid upholstered bed bases 2*a*.

The footboard extension 3 in turn may include a solid upholstered bed base 3*a*. The solid upholstered bed base 3*a* of the footboard extension 3 is shorter than the solid upholstered bed bases 2*a* of the lateral extensions 2. The footboard extension 3 has at least two hinges 12 on its inner surface, one arranged at each end, coupled to its corresponding L-adjusting tube 5, provided at one free end thereof with a clamp 13 for coupling with the structural tube 5 of the lateral extensions 2.

The solid upholstered bed bases 2*a* of the lateral extensions 2 and the solid upholstered bed base 3*a* of the footboard extension 3 may be provided on the top thereof with a padded reinforcement 14 throughout their length.

The solid upholstered bed base 2*a* of the lateral extensions 2 and the solid upholstered bed base 3*a* of the footboard extension 3 may be adjustable in height through a threaded insert 15.

The lateral extensions 2 having the upholstered bed bases 2*a* may be provided with a coupling hinge joint 16 in its central portion. The footboard extension 3 with the upholstered bed base 3*a* may further include, in a central portion thereof, a corresponding coupling hinge joint 16. The coupling hinge joint 16 can be actuated, for being raised or lowered, manually or by a remotely controlled electric motor M.

Figure 21A:
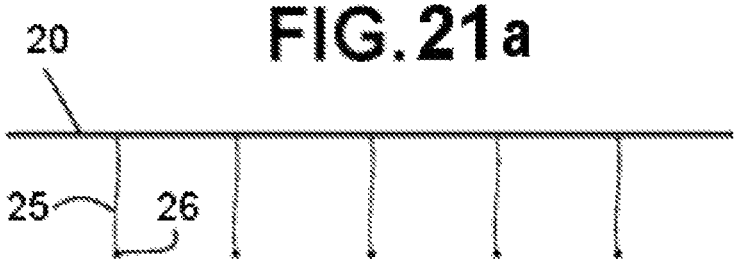
FIGS. 21*a* and 21*b*, shows elevation and plan views of the fitted sheet.
Figure 21B:
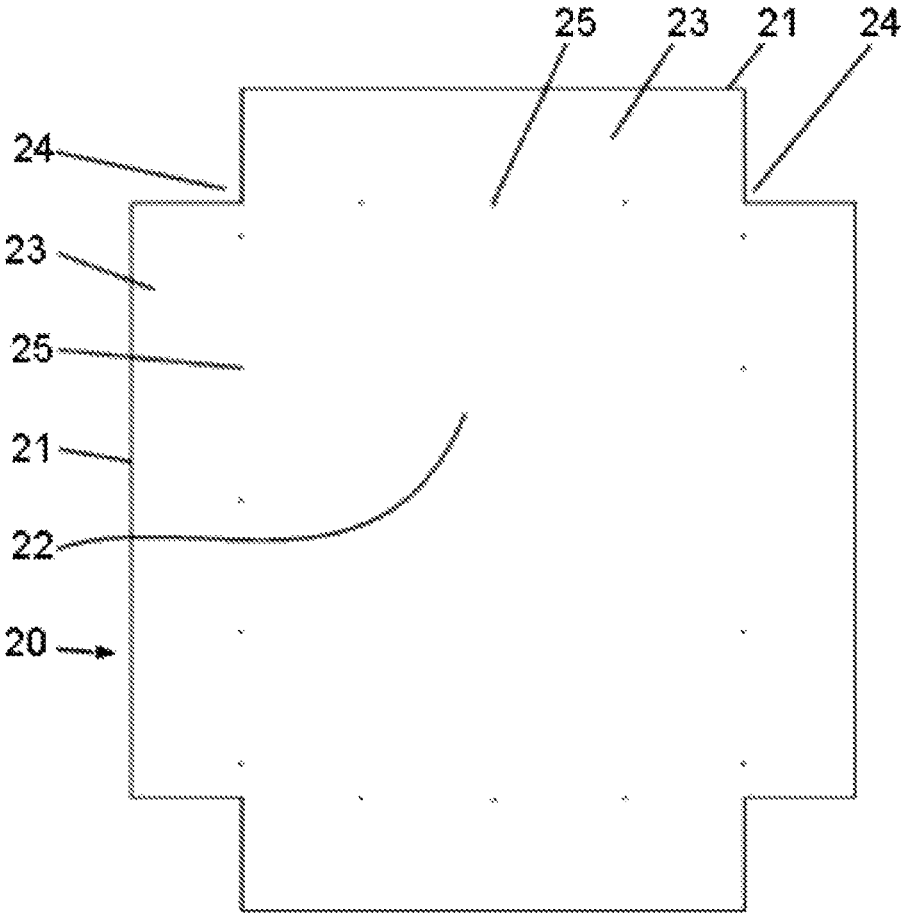
Figure 22:
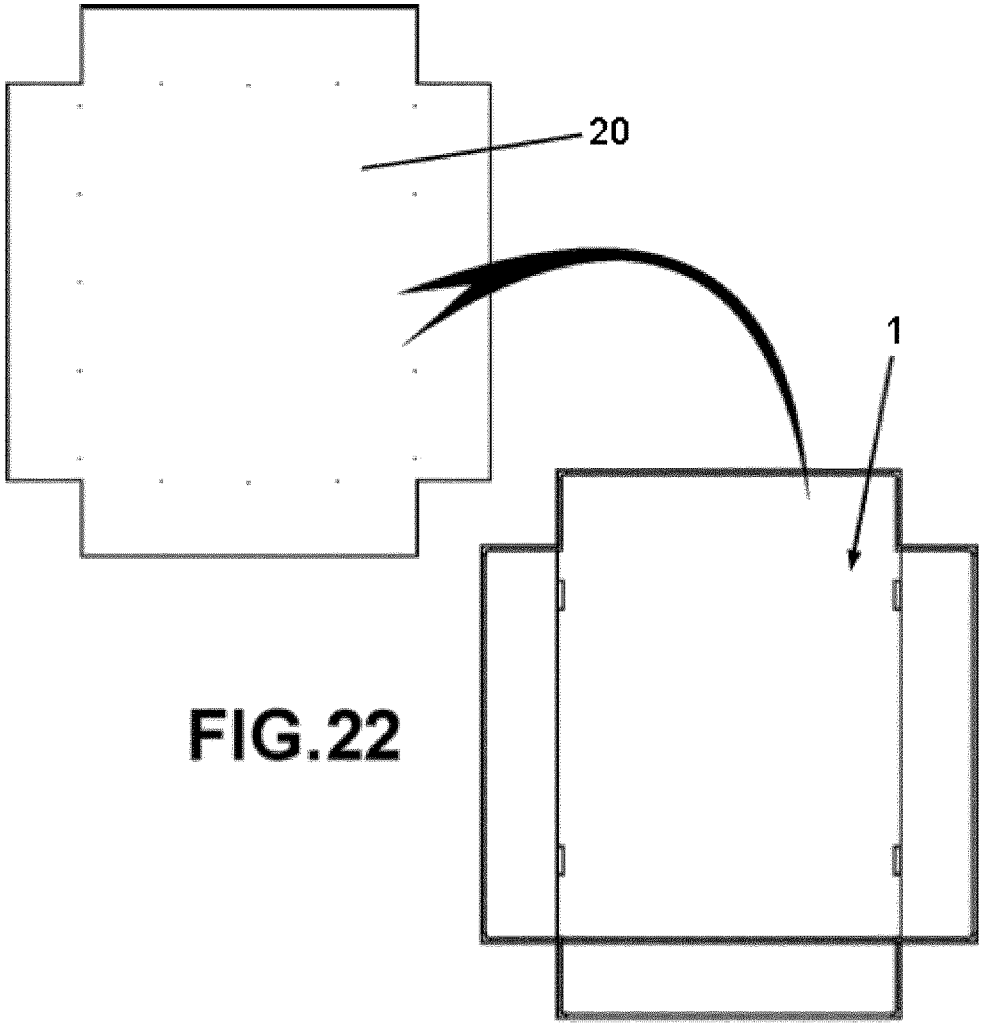
FIG. 22 shows a plan view of the fitted sheet for being placed on the mattress assembly where lateral and footboard extensions are shown.
Figure 23:
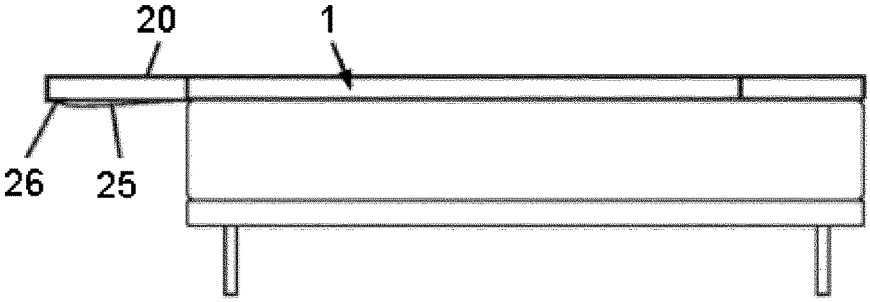
FIG. 23 shows a detail of the coupling of the fitted sheet on the mattress assembly with the attachment of the textile section with the side of the sheet being shown in detail.
Figure 24:
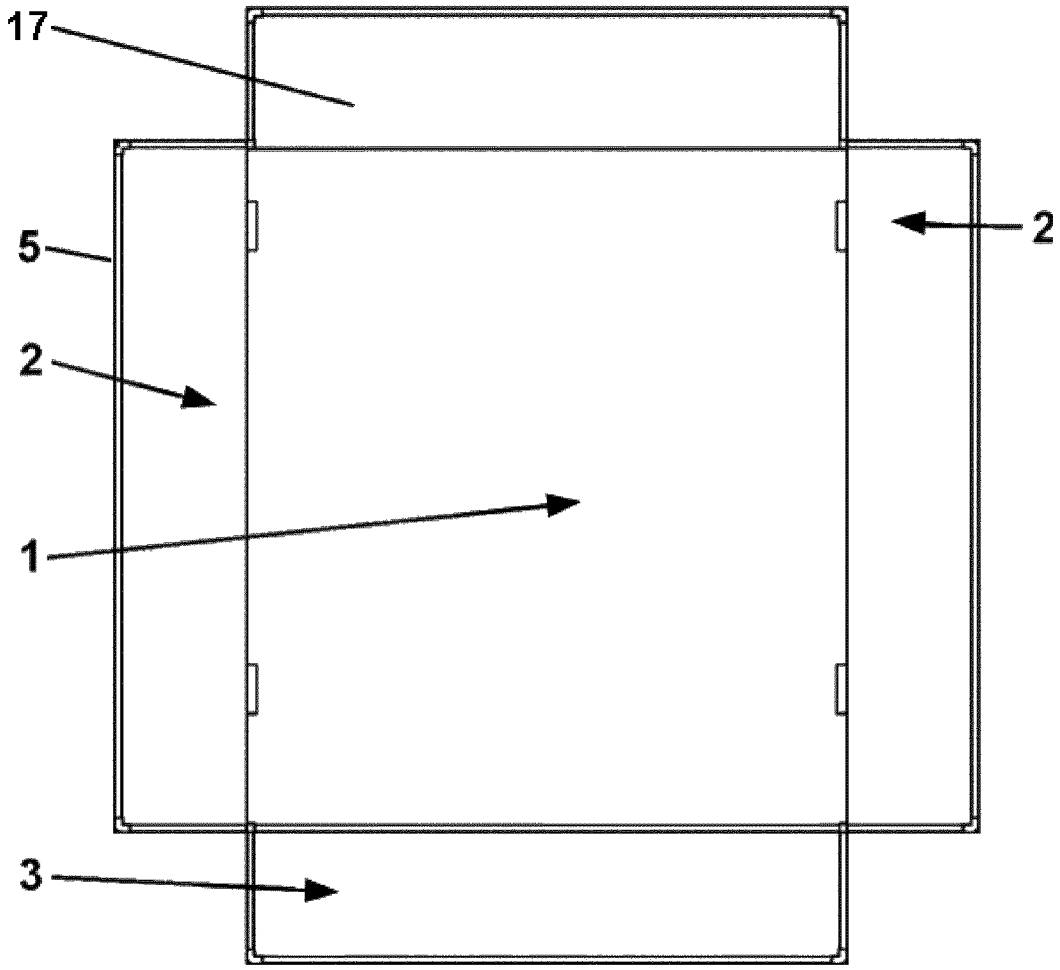
FIG. 24 shows a plan view of the supplement mattress from its back surface.
Figure 25:
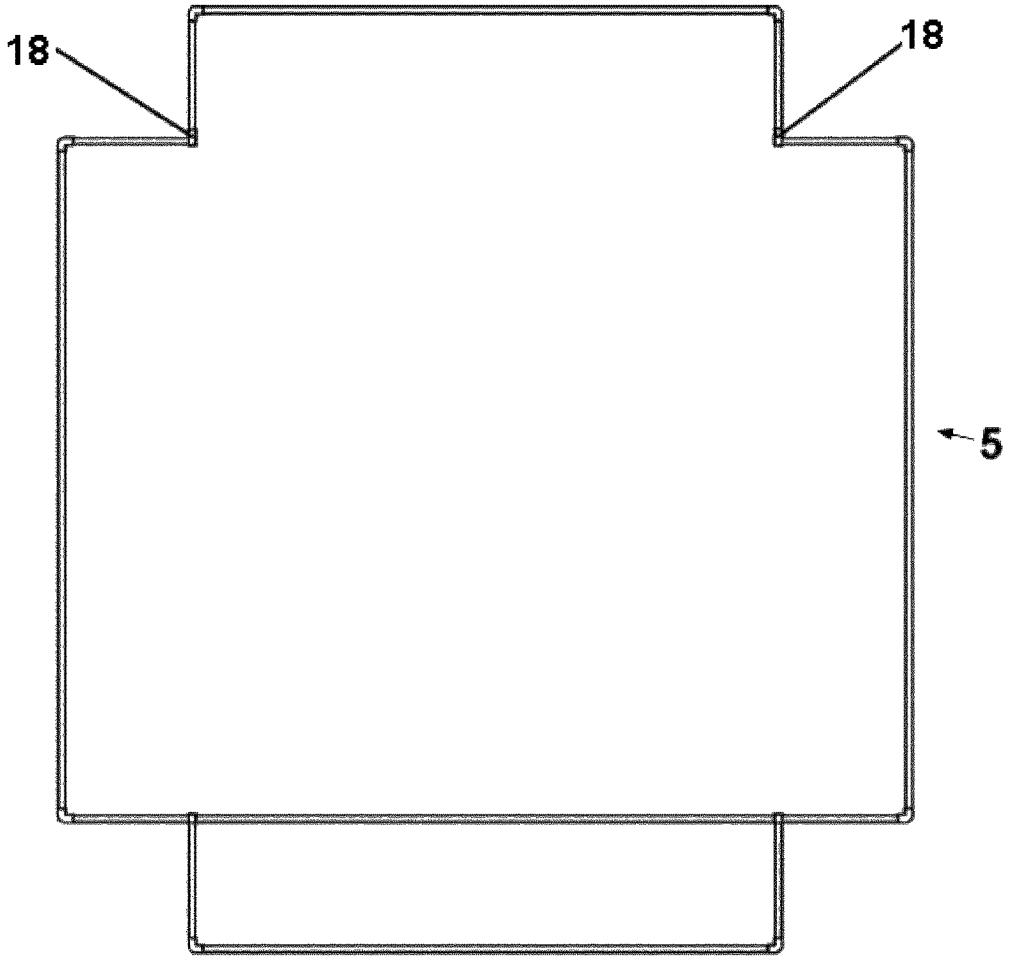
FIG. 25 shows a plan view of the tubular structure.
Figure 26:
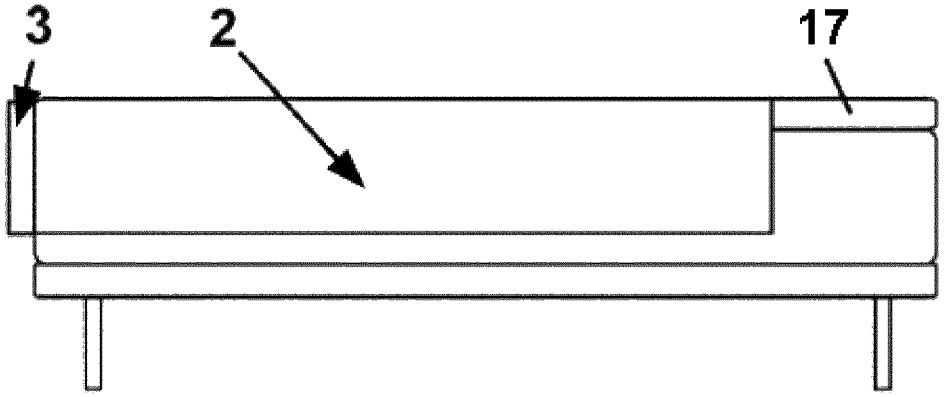
FIG. 26 shows an elevational view of the supplement mattress fitted on the main mattress in rest position.
Figure 27:
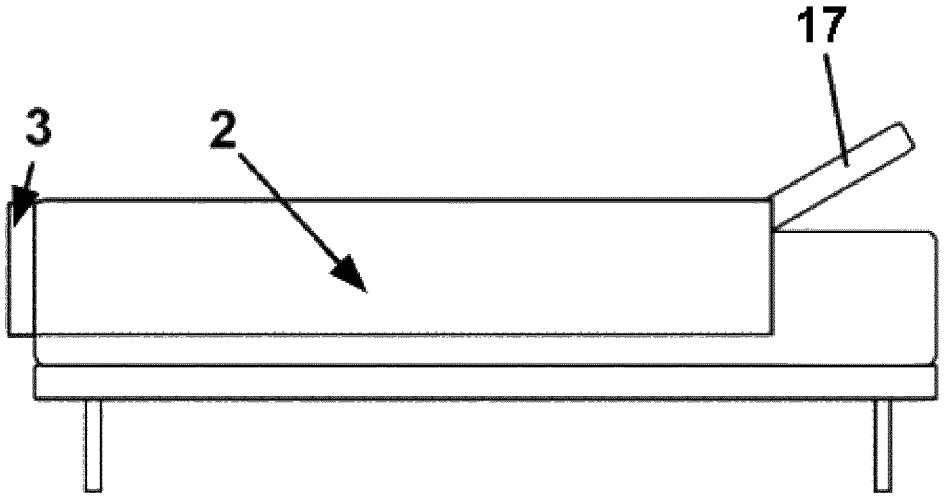
FIG. 27 shows an elevational view of the supplement mattress fitted on the main mattress showing the headboard elevation.
Figure 28:
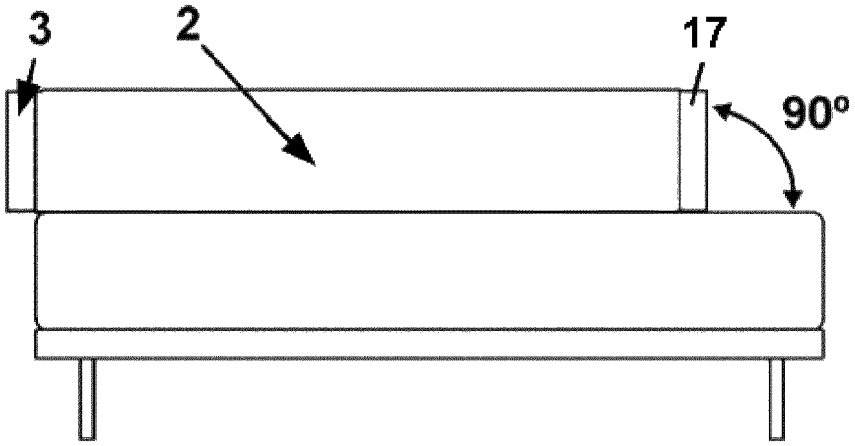
FIG. 28 shows an elevational view of the supplement mattress fitted on the main mattress with lateral, footboard and headboard extensions forming a security barrier for preventing the user from falling down.
Figure 29:
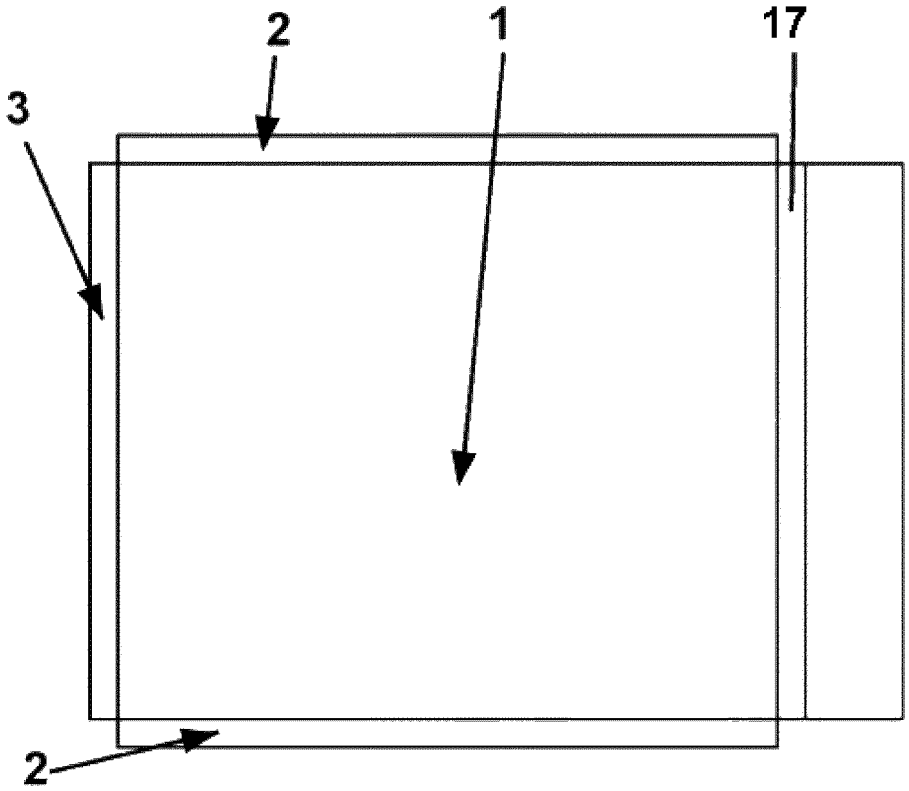
FIG. 29 shows a plan view of the supplement mattress of the present mattress assembly.
Figure 30:
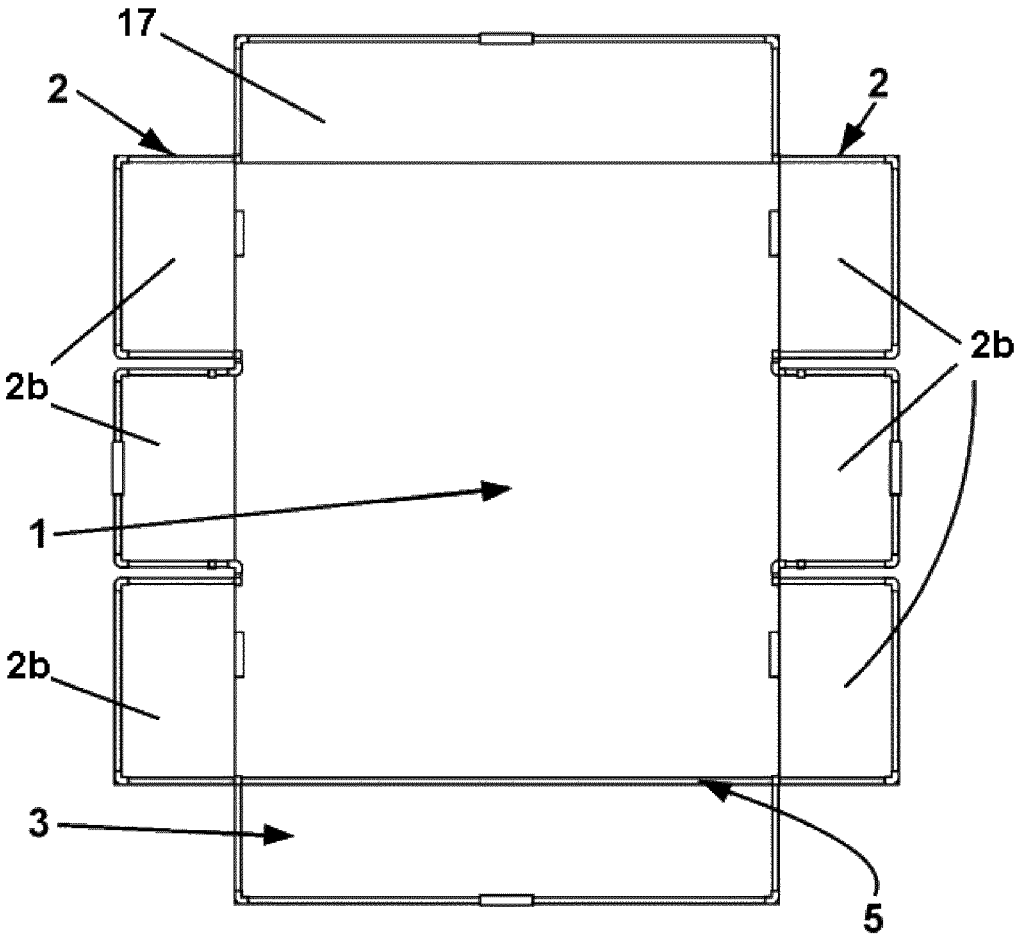
FIG. 30 shows a plan view of the supplement mattress from its back, showing the lateral extensions with three separate areas.
Figure 31:
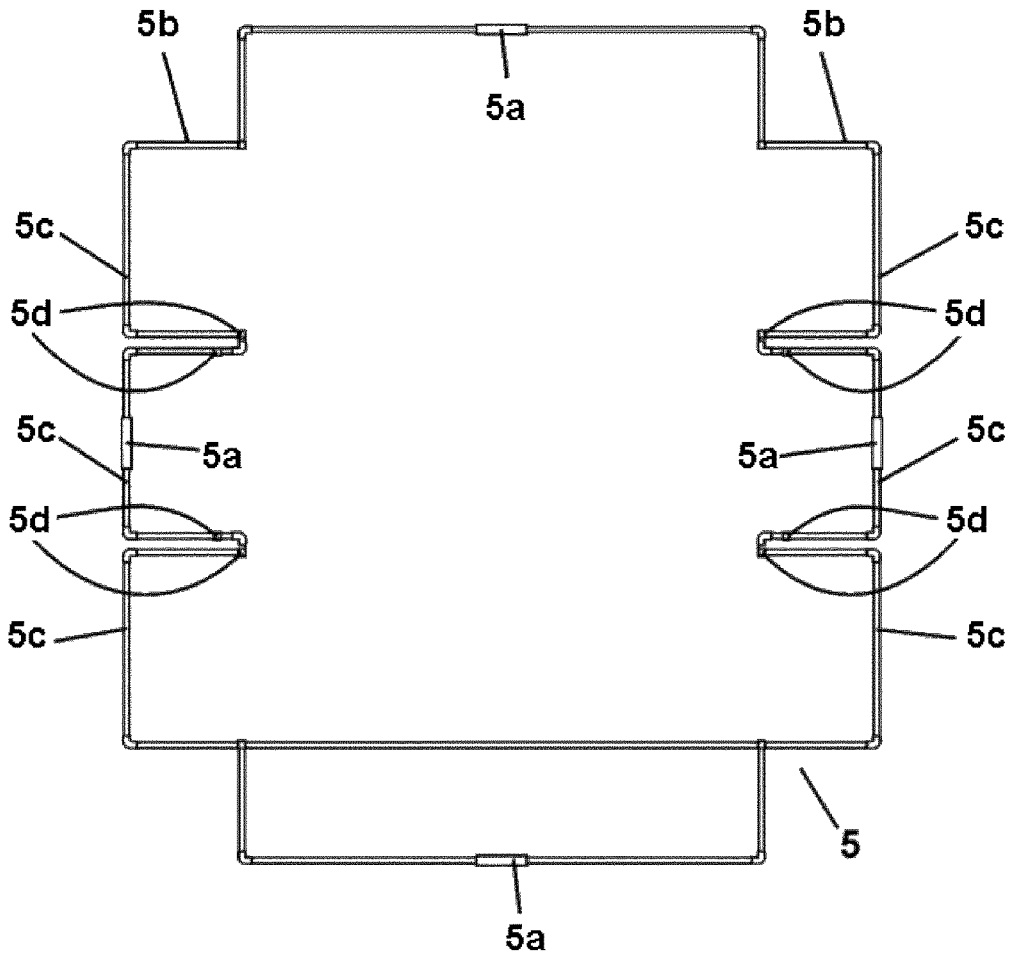
FIG. 31 shows a plan view of the tubular structure.
Figure 32:
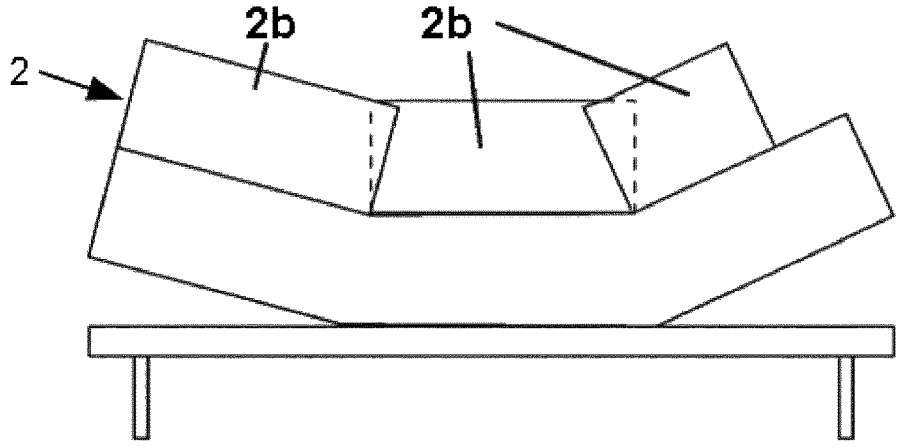
FIG. 32 shows an elevational view of the supplement mattress fitted on the main mattress with a hinged base, with the lateral extensions formed by three separate areas forming a safety barrier to prevent the user from falling down.
Figure 33:
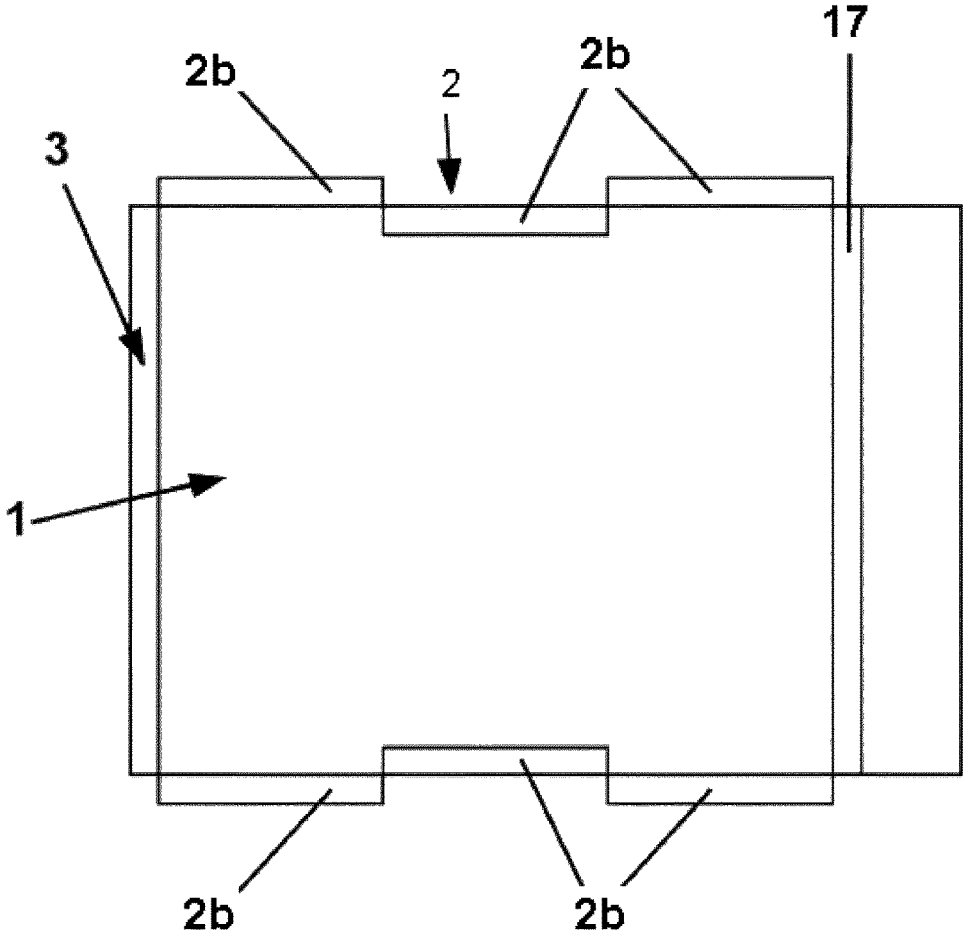
FIG. 33 shows a plan view of the supplement mattress showing the linear slope of the three separate areas forming the lateral extensions.

FIG. 21 (not separately shown but includes and is defined by sub-part FIGS. 21*a* and 21 *b*), 22 and 23 illustrate one example of a fitted sheet 20 that may be included in the present mattress assembly. The fitted sheet 20 may include an elastic element 21 along its entire perimeter and a main body 22 provided with lateral extensions 4. The elastic element 21 of the fitted sheet 20 prevents it from coming out of the lateral and footboard extensions 2, 3 of the supplement mattress 1.

The ends of the fitted sheet 20 are configured by a cutout 24 forming an angle of 90° and several textile sections 25. The textile sections 25 are provided in the connection between the main body 22 with the lateral extensions 23, with fasteners 26 at their free end. Said textile sections 25 can be passed through slots formed in the supplement mattress 1 such that the free end of said textile sections 25 fits the fitted sheet 20 through fasteners 26. This ensures a perfect placement for when the user extends the lateral extensions 2 of the supplement mattress 1 preventing the fitted sheet 20 from coming out of the lateral extensions 2 of the mattress assembly.

Reference is now made to FIGS. 24-29 of the drawings. As stated above, in this example of the mattress assembly a headboard extension 17 may be provided.

In this example shown in FIGS. 24-29 of the drawings, the tubular structure 5 has two hinges 18 in the connecting angle between the headboard extension 17 and the lateral extensions 2. This allows an angle of rotation for raising the hinged headboard 17 at different fixed positions up to a maximum of 90° relative to the mattress 1. This also allows a security barrier to be formed preventing children, disabled and dependent adults from falling to the ground.

Reference is now made to FIGS. 30-33. In this example, the lateral extensions 2 are configured into several separate areas 2*b*. The separate areas 2*b* of the lateral extensions 2 are adaptable to corresponding hinged bases movable as they can be rotated through an elevation angle at different fixed positions up to a maximum of 90° relative to mattress 1. The separate areas 2*b* of the lateral extensions 2 can be rotated together with the flexible and/or adjustable tube sections 5*a* of the tubular structure 5.

The frame 5*b* of the tubular structure 5 corresponding to the lateral extensions 2 may be configured on both sides by several separate hinged areas 5*c* coincident with the above mentioned separate areas 2*b*. Hinges 5*d* are attached to the other hinge 5*d* that is adjacent to a linear slope equivalent to the supplement mattress thickness. This prevents different parts from overlapping each other as they are hinged, enabling a complete adaptability to hinged bases.

The flexible and/or adjustable sections 5*a* provided on the perimeter in the tubular structure 5, in the footboard extension 3, headboard extension 17 and lateral extensions 2 enable a perfect adaptation of the tubular structure 5 to the supplement mattress 1.

The flexible and/or adjustable tube sections 5*a* of the tubular structure 5 may be configured with an elastic material or any other equivalent structure facilitating the tubular structure 5 to be folded.

Although only a number of particular examples of the present mattress assembly have been disclosed herein, it will be understood by those skilled in the art that other alternative examples and/or uses and obvious modifications and equivalents thereof are possible.

For example, an automation driving system could be provided for driving the lateral extensions and/or the footboard extension and/or the headboard extension, and/or the tubular structure of the present mattress assembly. This driving system could include the above mentioned electric motor M for driving said extensions and/or the tubular structure and it could be remotely actuated by the user. Remote control could be performed through a control unit having e.g. an appropriate user interface or through a suitable mobile application.

The bed bases 2*a*, 2*b* of the lateral extensions 2 and the bed bases 3*a* of the footboard extension may be provided with at least two hinges at the ends of its back, positioned one at each end, provided with a coupling hinge joint 16 in different positions other than the central portion. Alternative structures and/or methods for raising and/lowering the coupling hinge joint 16 other than manually or by the remotely controlled electric motor M are not ruled out.

Furthermore, the tubular structure could be made of solid tube sections of any shape in cross-section, such as circular, oval, polygonal, etc.

In addition, examples in which the supplement mattress 1 has a single lateral extension are not ruled out. Moreover, there could be examples in which different lateral extensions are provided having different properties and/or functionalities from each other. For example, at least one of the lateral extensions of the supplement mattress could be rigid. Different functionalities of the lateral extensions include areas for holding items, and/or areas for storing items, etc.

On the other hand, the fitted sheet 20 might be provided with upper and lower side channels inside of which an elastic element could be provided so that the side portions of assembly can be suitably wrapped by the fitted sheet 20.

In some examples, the inner central section 7*a* of the tubular structure 5 shown in FIG. 1 could be not present.

Finally, an additional reinforcing structure could be provided for reinforcing the mattress assembly. This additional reinforcing structure could be adapted for holding the corners of the tubular structure in position.

Therefore, the present disclosure covers many but not all possible combinations of the particular examples of the present mattress assembly described.

Reference signs related to drawings and placed in parentheses in a claim are solely for attempting to increase the intelligibility of the claim, and shall not be construed as limiting its scope. Thus, the scope of the present disclosure should not be limited by particular examples, but should be determined only by a fair reading of the claims that follow.

The invention claimed is:

1. A mattress assembly comprising:

a main mattress;

a supplement mattress attached thereto, the supplement mattress having a main body having at least one lateral extension connected thereto; and a tubular structure configured to be fixedly attached to and disposed along the entire perimeter of the supplement mattress, a first portion of the tubular structure disposed around a portion of the perimeter of the main body, and a second portion of the tubular structure disposed around a portion of the at least one lateral extension, and the second portion of the tubular structure disposed being hingedly attached to the first portion of the tubular structure;

said at least one lateral extension forming an extension surface in a horizontal plane to the main body when rotated 90° or forming an extension surface perpendicular thereto when rotated 180°, in collaboration with the tubular structure provided along the perimeter of the supplement mattress.

2. The assembly of claim 1, wherein the tubular structure is fixedly provided along the perimeter of the supplement mattress.

3. The assembly of claim 1, wherein the tubular structure is provided with one or both fast opening and closing devices.

4. The assembly of claim 1, wherein the supplement mattress further comprises one or both of:

a footboard extension; and a headboard extension that, one or both together with or apart from the tubular structure, can be rotated at different elevation angles, up to a maximum of 90°.

5. The assembly of claim 4, wherein the tubular structure has two hinges in the connecting angle between the headboard extension and the at least one lateral extension.

6. The assembly of claim 4, wherein the tubular structure comprises two long sections, for assembling of the at least one lateral extension, three central sections, one for assembling of the headboard extension and two for assembling of the footboard extension and for connecting the footboard extension with the main body and eight short sections for assembling of the angles formed by connection between the at least one lateral extension and the footboard extension, with the main body, all the sections being attached to each other by eight bends and four hinges rotatable through 90° and 180°, positioned at connecting angles between main body and the at least one lateral extension and the footboard extension.

7. The assembly of claim 4, wherein at least one of the at least one lateral extension and the footboard extension, is rigid.

8. The assembly of claim 4, wherein the headboard extension comprises separate hinged areas movable through an elevation angle at different fixed positions.

9. The assembly of claim 1, wherein the supplement mattress includes one or both clamps or girths positioned at both sides of its back for coupling it to the main mattress.

10. The assembly of claim 1, further comprising a fitted sheet comprising an elastic element along its perimeter, a main body that is provided with at least one lateral extension, the ends of the fitted sheet being configured by a cutout forming an angle of 90°, several textile sections being provided in the connection between the main body with the at least one lateral extension, provided with fasteners at their free end.

11. The assembly of claim 1, wherein the at least one lateral extension of the mattress assembly comprises separate areas adaptable to hinged bases, movable through an elevation angle at different fixed positions, up to a maximum of 90°.

12. The assembly of claim 11, wherein the at least one lateral extension comprises one or more separate hinged areas, coincident with the separate areas of the supplement mattress, separated from each other through corresponding hinges, which are positioned attached to the hinge adjacent to a linear slope equivalent to the supplement mattress thickness.

13. The assembly of claim 4, further comprising an automation driving system for driving at least one of the at least one lateral extension, the footboard extension, the headboard extension, and the tubular structure.

14. The assembly of claim 1, wherein the tubular structure is made of solid tube sections.

* * * * *